US007588008B2

(12) United States Patent
Ogawa et al.

(10) Patent No.: US 7,588,008 B2
(45) Date of Patent: Sep. 15, 2009

(54) INTAKE SYSTEM OF INTERNAL COMBUSTION ENGINE

(75) Inventors: Shuji Ogawa, Toyota (JP); Motonobu Hasegawa, Kariya (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 57 days.

(21) Appl. No.: 11/979,810

(22) Filed: Nov. 8, 2007

(65) Prior Publication Data

US 2008/0110430 A1 May 15, 2008

(30) Foreign Application Priority Data

Nov. 10, 2006 (JP) ..... 2006-304633

(51) Int. Cl.
*F02M 35/10* (2006.01)
*F02D 9/08* (2006.01)

(52) U.S. Cl. ..... 123/184.21; 123/184.53; 123/336

(58) Field of Classification Search ..... 123/184.21, 123/184.53, 184.56, 184.61, 306, 336
See application file for complete search history.

(56) References Cited

U.S. PATENT DOCUMENTS 6,604,506 B2 8/2003 Tanaka et al.
7,121,246 B2 10/2006 Uchiyama
7,252,064 B2 * 8/2007 Koenneker et al. ..... 123/184.53

FOREIGN PATENT DOCUMENTS

| | | |
|---|---|---|
| JP | 2002-106370 | 9/2000 |
| JP | 2005-61231 | 8/2003 |
| JP | 2006-233907 | 2/2005 |

* cited by examiner

*Primary Examiner*—Noah Kamen
(74) *Attorney, Agent, or Firm*—Stites & Harbison, PLLC; Juan Carlos A. Marquez, Esq.

(57) ABSTRACT

An intake system of an internal combustion engine includes an engine head, a resin made intake manifold mounted at the engine head and having intake passages, the resin made intake manifold forming a receiving portion on an inner wall of each intake passage at a downstream side, and a control unit disposed at the receiving portion and including a resin made cartridge, an opening and closing valve disposed at the cartridge, and a shaft rotating the valve, wherein a clearance is provided between an inner circumferential surface of the receiving portion and an outer circumferential surface of the cartridge to allow deformation of the resin made intake manifold, and the cartridge is provided with a flange held between the engine head and the resin made intake manifold.

9 Claims, 4 Drawing Sheets

INTAKE SYSTEM OF INTERNAL COMBUSTION ENGINE

CROSS REFERENCE TO RELATED APPLICATIONS

This application is based on and claims priority under 35 U.S.C §119 with respect to Japanese Patent Application 2006-304633, filed on Nov. 10, 2006, the entire content of which is incorporated herein by reference.

FIELD OF THE INVENTION

This invention relates to an intake system of an internal combustion engine.

BACKGROUND

Recently, resin made intake manifolds, instead of metals such as aluminum alloy castings, are widely adopted from the perspective of weight saving, thermal insulating properties and improvement in design flexibility for vehicle gasoline engines. However, if resin is used for the intake manifold, warpage and shrinkage are unavoidable in the molding process, and thus form accuracy of the intake manifold tends to lower compared to those of the metals.

In case of a four-cylinder engine, an intake manifold has four intake passages at a body thereof and an intake system which controls an amount or flow velocity and direction of intake air as needed. The intake system is configured so that an opening and closing valve, which is opened and closed by a shaft, is disposed in each intake passage. The opening of the opening and closing valve is controlled by an actuator for obtaining an optimal engine combustion state in accordance with the running condition of the vehicle.

In the intake system of the combustion engine disclosed in JP 2006-233907A, a cartridge of a control unit is inserted into a receiving portion with a predetermined clearance and is held via an elastic member.

In the intake system of the combustion engine disclosed in JP 2002-106370A, a notch is provided at a peripheral wall of a frame member (cartridge) of the control unit and thereby enabling the frame to elastically shrink and deform for allowing the deformation of the frame member.

However, in the invention disclosed in JP 2006-233907A, when the intake manifold is deformed due to its dimensional change caused by thermal expansion or fluid absorption, the cartridge of the control unit may be deformed via the elastic member. If the cartridge is deformed, the opening and closing valve might be accidentally locked, or bearings of the shaft might not be aligned at desired positions with high accuracy, leading to increases in sliding friction and wear of the bearings when rotating the opening and closing valve. If a clearance defined between the cartridge and the opening and closing valve is enlarged in order to prevent the locking of the opening and closing valve, a sealing performance might deteriorate at the time of closure of the opening and closing valve.

In the invention disclosed in JP 2002-106370A, the clearance defined between the frame member and the opening and closing valve should be formed to be relatively large in order to allow the deformation of the frame member, and thus deteriorating the sealing performance at the time of the closure of the opening and closing valve.

A need exists for an intake system of an internal combustion engine which is not susceptible to the drawback mentioned above.

SUMMARY OF THE INVENTION

According to an aspect of the present invention, an intake system of an internal combustion engine includes an engine head, a resin made intake manifold mounted at the engine head and having a plurality of intake passages, the resin made intake manifold forming a receiving portion on an inner wall of each intake passage at a downstream side thereof, and a control unit disposed at the receiving portion, the control unit including a resin made cartridge, an opening and closing valve disposed at the cartridge and a shaft rotating the opening and closing valve, wherein a clearance is provided between an inner circumferential surface of the receiving portion and an outer circumferential surface of the cartridge to allow deformation of the resin made intake manifold, and the cartridge is provided with a flange held between the engine head and the resin made intake manifold.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An internal system of an internal combustion engine according to an embodiment of the invention is described with reference to drawings.

Figure 1:
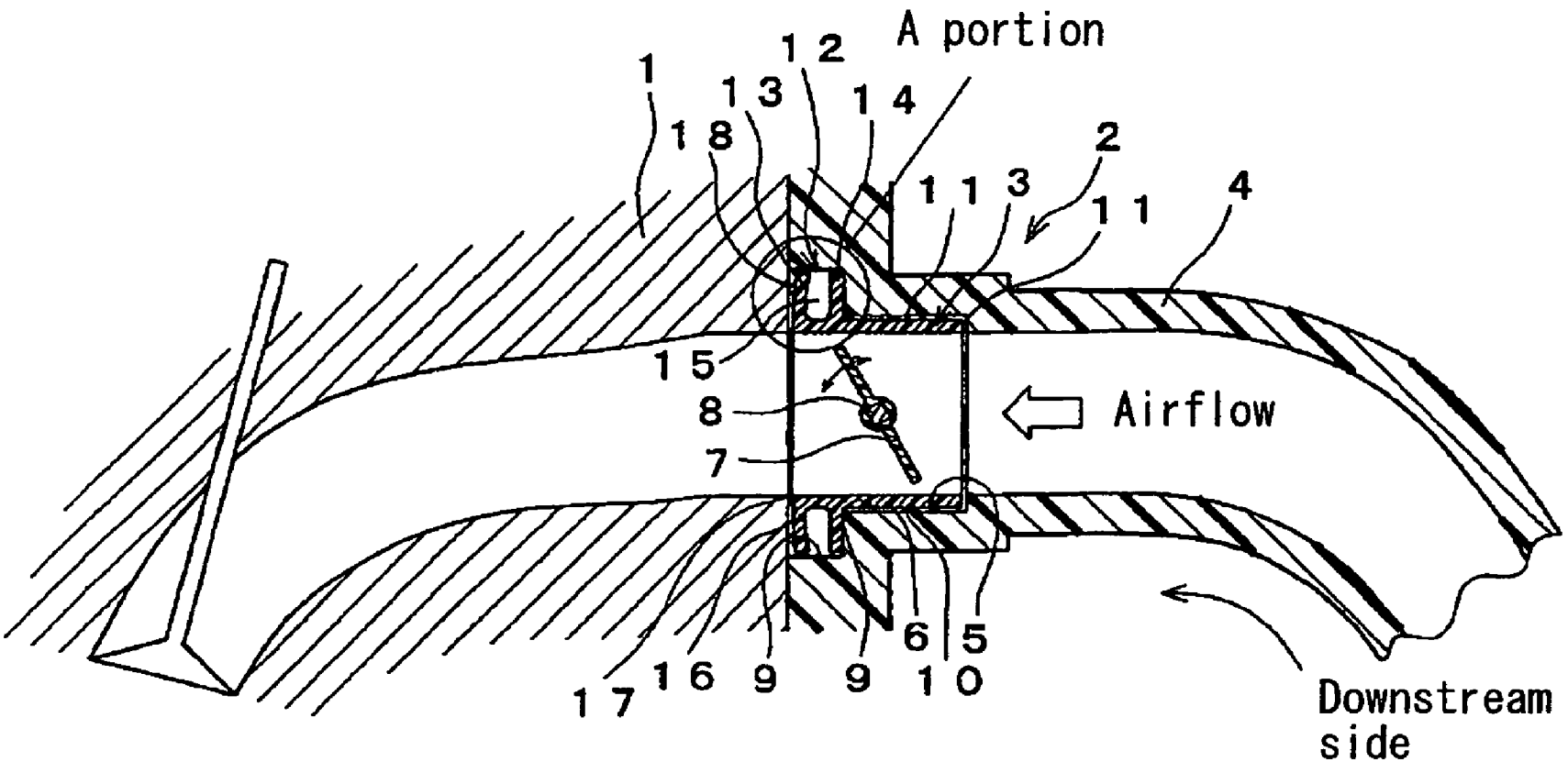
FIG. 1 is a sectional view of an intake system of an internal combustion engine according to an embodiment of the present invention.

FIG. 1 is a sectional view of the internal system of the internal combustion engine according to the embodiment of the invention. The internal system of the internal combustion engine is structured with an engine head 1, an intake manifold 2, and a control unit 3. The intake manifold 2 is mounted at the engine head 1 by a fastening member such as a bolt (not shown), and the control unit 3 is disposed between the engine head 1 and the intake manifold 2. The intake manifold 2 is made of resin and forms a receiving portion 5 on an inner wall of each intake passage 4 at a downstream side thereof.

The control unit 3 is disposed at the receiving portion 5 of the intake manifold 2 and is structured with a resin made cartridge 6, an opening and closing valve 7 disposed at the cartridge 6, a shaft 8 rotating the opening and closing valve 7 in the cartridge 6. A clearance 11 is provided between an inner circumferential surface 9 of the receiving portion 5 and an outer circumferential surface 10 of the cartridge 6 to allow the deformation of the intake manifold 2. A flange 12 is provided at the cartridge 6. The flange 12 forms a double flange structure which is composed of an elastic flange portion 13 and a fixed flange portion 14, and a space 15 is defined between the elastic flange portion 13 and the fixed flange portion 14.

Figure 2:
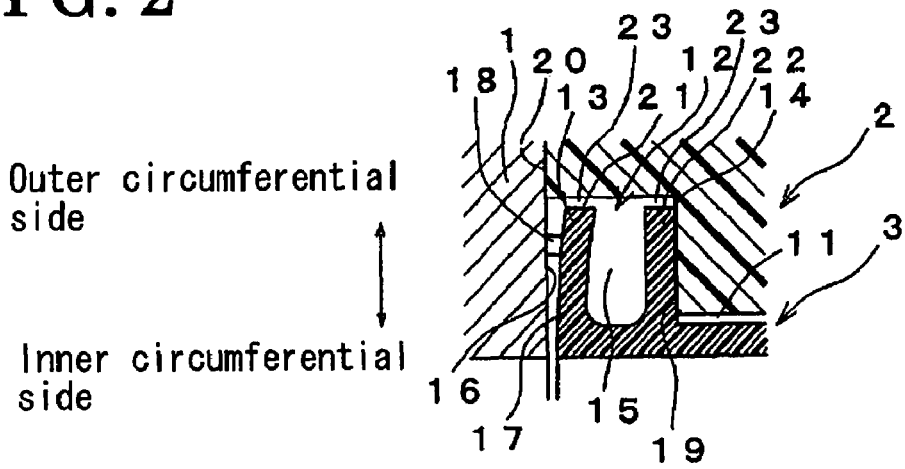
FIG. 2 is a diagram illustrating an A portion in detail.
Figure 6:
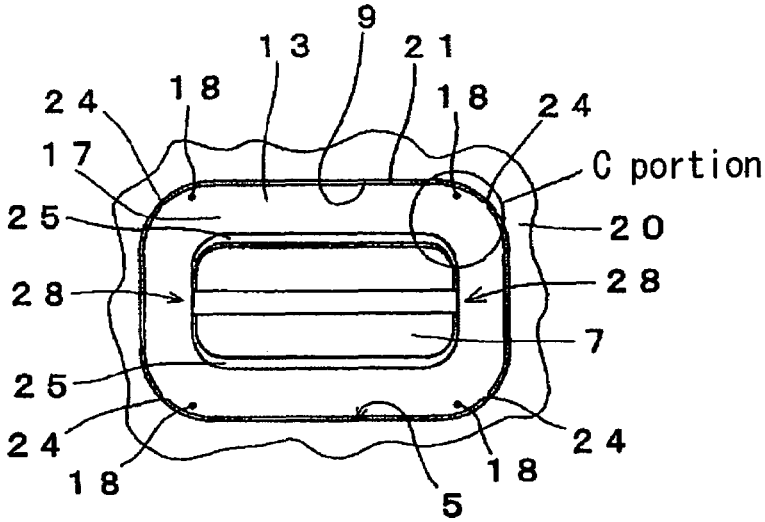
FIG. 6 is a diagram illustrating a control unit viewed from a side of the engine head, with the engine head removed.

FIG. 2 illustrates an A portion in detail and an assembling state of the flange 12. A flange surface 17 of the cartridge 6 faces a mounting surface 16 of the engine head 1, at which the elastic flange portion 13 is mounted. A protrusion 18 is provided in the vicinity of each corner of the elastic flange portion 13 (i.e. four protrusions 18 are provided in the elastic flange portion 13 as shown in FIG. 6). Each protrusion 18 is integrally formed with the elastic flange portion 13 on an outer circumferential side of the flange surface 17. The engine head 1 presses the elastic flange portion 13 toward the space 15 with the protrusions 18, and a supporting surface 19 formed at the receiving portion 5 of the intake manifold 2 presses the fixed flange portion 14 toward the space 15. Consequently, the flange 12 is held between the engine head 1 and the intake manifold 2 and thereby holding the cartridge 6 in the receiving portion 5.

A mounted surface 20 of the intake manifold 2, which is mounted at the engine head 1, is in contact with the mounting surface 16 of the engine head 1, but the flange surface 17 is located at a position recessed from the mounted surface 20, which is mounted at the engine head 1, and thus the mounted surface 20 is not in contact with the flange surface 17.

Figure 3:
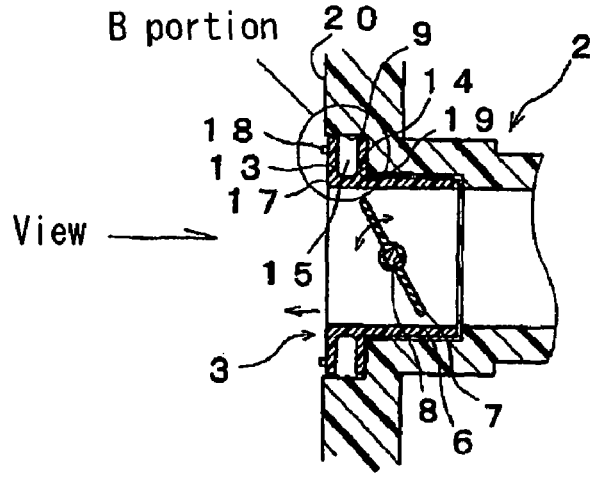
FIG. 3 is a sectional view illustrating a state that an intake manifold is removed from an engine head.

FIG. 3 is a sectional view illustrating a state that the intake manifold 2 is removed from the engine head 1. In this state, the flange 12 is not held between the engine head 1 and the intake manifold 2. When the shaft 8, which rotates the opening and closing valve 7, is removed, the cartridge 6 may move toward the engine head 1.

Figure 4:
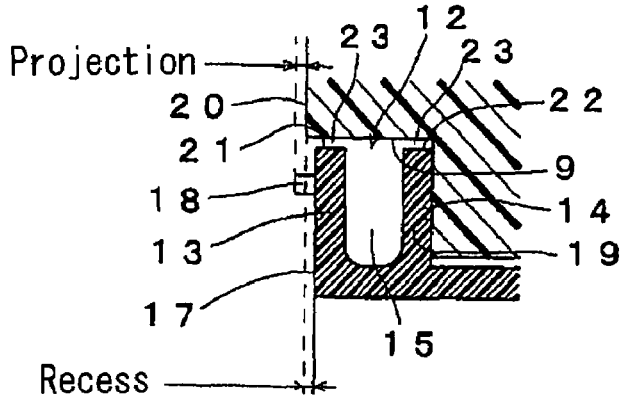
FIG. 4 is a diagram illustrating a B portion in detail.

FIG. 4 illustrates a B portion in detail and the flange 12, with the intake manifold 2 removed from the engine head 1. When each protrusion 18 is not in contact with the engine head 1, the protrusion 18 protrudes toward the engine head 1 with respect to the mounted surface 20 of the intake manifold 2. The flange surface 17 remains at the position recessed from the mounted surface 20. A clearance 23 is respectively provided between the inner circumferential surface 9 of the receiving portion 5 and an outer circumferential surface 21 of the elastic flange portion 13 and between the inner circumferential surface 9 of the receiving portion 5 and an outer circumferential surface 22 of the fixed flange portion 14.

Figure 5:
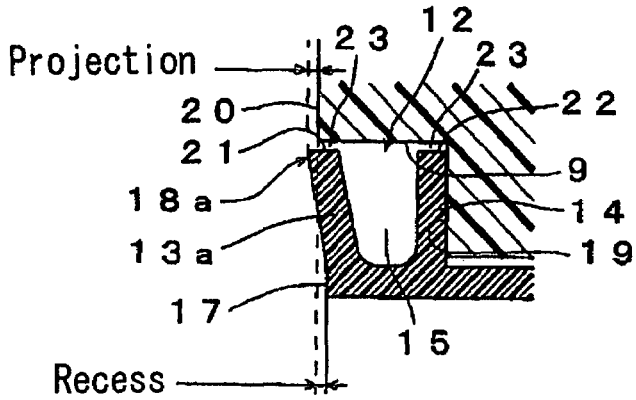
FIG. 5 is a diagram illustrating a modification of FIG. 4.

FIG. 5 illustrates a modification of FIG. 4, the identical reference numerals are provided for portions having the common configuration with FIG. 4. An outer circumferential side 18*a* of an elastic flange portion 13*a* is protruded toward the engine head 1, with the intake manifold 2 removed from the engine head 1. In this modification, the outer circumferential side 18*a* of the elastic flange portion 13*a* functions similarly to the protrusions 18 of FIG. 4. The engine head 1 presses the elastic flange portion 13*a* toward the space 15 with the outer circumferential side 18*a* and the supporting surface 19 formed in the receiving portion 5 of the intake manifold 2 presses the fixed flange portion 14 toward the space 15. Thus, the flange 12 is held between the engine head 1 and the intake manifold 2 and thereby holding the cartridge 6 in the receiving portion 5.

FIG. 6 is a diagram of the control unit 3 viewed from the side of the engine head 1, with the engine head 1 removed (shown in FIG. 3). A positioning protrusion 24 is provided at each corner of the outer circumferential surface 21 of the elastic flange portion 13.

Figure 7:
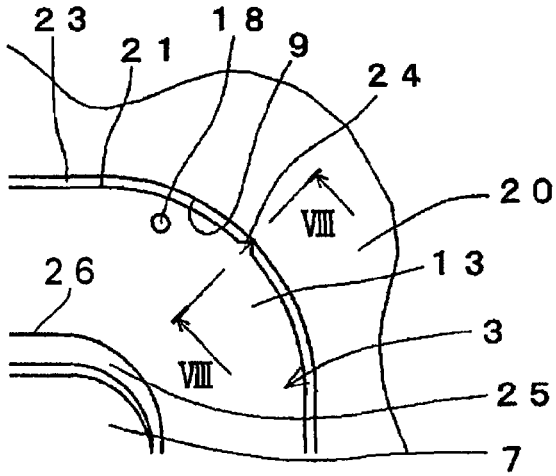
FIG. 7 is a sectional view illustrating a C portion in detail.

FIG. 7 illustrates a C portion in detail, and each of the four positioning protrusions 24 is in contact with the inner circumferential surface 9 of the intake manifold 2. A clearance 25 is provided between the opening and closing valve 7 and an inner circumferential surface 26 of the cartridge 6 to prevent the opening and closing valve 7 from the accidental locking caused by contacting with the inner circumferential surface 26 of the cartridge 6 when rotating the opening and closing valve 7.

Figure 8:
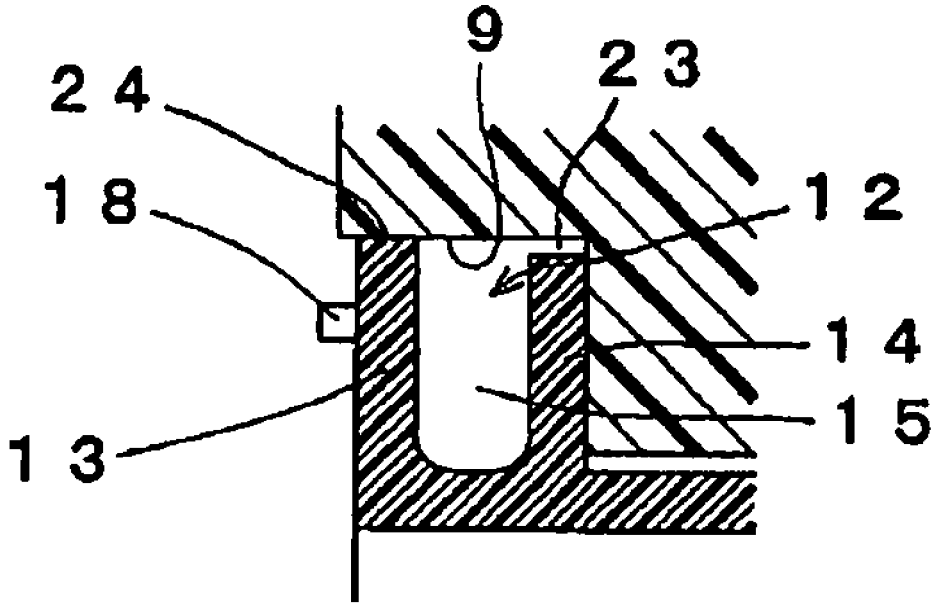
FIG. 8 is a sectional view taken along line VIII-VIII.

FIG. 8 is a sectional view taken along line VIII-VIII illustrating a state that the positioning protrusion 24 is in contact with the inner circumferential surface 9 of the intake manifold 2. FIG. 8 illustrates a state that the engine head 1 is removed. However, even if the intake manifold 2 is mounted at the engine head 1, each positioning protrusion 24 is in contact with the inner circumferential surface 9 of the intake manifold 2 to position the cartridge 6 in the receiving portion 5. Also, each positioning protrusion 24 is integrally formed with the elastic flange portion 13.

In the intake system of the present invention, the clearance 11 is provided between the inner circumferential surface 9 of the receiving portion 5 and the outer circumferential surface 10 of the cartridge 6 to allow the deformation of the intake manifold 2, and the flange 12, which is held between the engine head 1 and the intake manifold 2, is provided at the cartridge 6. This structure allows the intake system to absorb the deformation of the intake manifold 2 by the clearance 11, and no influence is exerted on the clearance 25 defined between the inner circumferential surface 26 of the cartridge 6 and the opening and closing valve 7 and the bearings 28 provided at the cartridge 6 to support the shaft 8. Therefore, the accidental locking of the opening and closing valve 7 and the increases in the sliding friction between the shaft 8 and the bearings 28 and the wear of the bearings 28 are prevented, and the excellent sealing performance is achieved at the time of the closure of the opening and closing valve 7. Further, the flange 12 is held between the engine head 1 and the intake manifold 2 and thus preventing the cartridge 6 from moving in the receiving portion 5.

The flange 12 is formed as the double flange structure which is provided with the elastic flange portion 13 and the fixed flange portion 14, and the space 15 is defined between the elastic flange portion 13 and the fixed flange portion 14. The structure allows the elastic flange portion 13 to be deformable toward the space 15 when holding the elastic flange portion 13 and the fixed flange portion 14 between the engine head 1 and the intake manifold 2. Thus, the force for fixing the intake manifold 2 with the non illustrated bolt and the like is reduced, compared to the case that the flange is not formed as the double flange structure.

The flange surface 17 of the cartridge 6 is provided with the protrusions 18, which are in contact with the engine head 1, and faces the mounting surface 16 of the engine head 1. The flange surface 17 is positioned at the position recessed from the mounted surface 20 of the intake manifold 2. This positioning allows the protrusions 18 to be in contact with the engine head 1 to securely hold the cartridge 6 between the engine head 1 and the intake manifold 2, even if the flange surface 17 of the cartridge 6 is not processed with the high processing accuracy. Therefore, the processing cost is reduced.

The protrusion 18 is provided in the vicinity of each corner of the elastic flange portion 13, where highly accurate processing is achieved, and thereby controlling the force of each protrusion 18 for pressing the engine head 1 and equalizing the force for holding the cartridge 6.

Each protrusion 18 is provided at the outer circumferential side of the flange surface 17 of the elastic flange portion 13, and thereby enlarging the elastic deformation amount of the elastic flange portion 13 toward the space 15, compared to the case that the protrusions 18 are provided at the inner circumferential surface of the elastic flange portion 13.

Each protrusion 18 is integrally formed with the elastic flange portion 13 and thereby reducing the manufacturing cost compared to the case that the protrusions 18 are separately provided.

The elastic flange portion 13 is elastically deformed toward the space 15 and holds the flange 12 in the direction that the air flows, and thus preventing the cartridge 6 from moving in the receiving portion 5.

The clearances 23 are provided between the inner circumferential surface 9 of the receiving portion 5 and the outer circumferential surface 21 of the elastic flange portion 13, and also provided between the inner circumferential surface 9 of the receiving portion 5 and the outer circumferential surface 22 of the fixed flange portion 14. Further, the four positioning protrusions 24 are provided at the outer circumferential surface 21 of the elastic flange portion 13. This structure enables the cartridge 6 to be positioned in the receiving portion 5. Even if the elastic flange portion 13 is deformed, no influence is exerted on the fixed flange portion 14, the outer circumferential surface 10 of the cartridge 6, and the bearings 28. Thus, the accidental locking of the opening and closing valve 7, the increases in the sliding resistance and the wear of the bearings 28 at the time of the rotation of the shaft 8, which are caused by the change of the mounting position of the cartridge 6, are prevented.

The positioning protrusion 24 is provided at each corner of the elastic flange portion 13, which the high processing accuracy is achieved, and thus improving the positioning accuracy of the cartridge 6 in the receiving portion 5.

The positioning protrusions 24 are integrally formed with the elastic flange portion 13 and thus reducing the manufacturing cost compared to the case that the positioning protrusions 24 are separately provided.

In the embodiment of the present invention, the positioning protrusions 24 are provided at the elastic flange portion 13. However, the positioning protrusions 24 may be provided at the fixed flange portion 14 or the receiving portion 5 of the intake manifold 2. Also, the flange 12 is provided at the entire circumference of the cartridge 6. However, the flange 12 may be provided at only a part of the circumference (for example, both ends of the shaft 8). Also, the forms of the protrusions 18 and the positioning protrusions 24 are not limited to particular forms as long as the operational effect of the present invention is achieved.

The principles, of the preferred embodiments and mode of operation of the present invention have been described in the foregoing specification. However, the invention, which is intended to be protected, is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. An intake system of an internal combustion engine, comprising:

an engine head;

a resin made intake manifold mounted at the engine head and having a plurality of intake passages, the resin made intake manifold forming a receiving portion on an inner wall of each intake passage at a downstream side thereof; and a control unit disposed at the receiving portion, the control unit including:

a resin made cartridge;

an opening and closing valve disposed at the cartridge; and a shaft for rotating the opening and closing valve, wherein a clearance is provided between an inner circumferential surface of the receiving portion and an outer circumferential surface of the cartridge to allow deformation of the resin made intake manifold, and the cartridge is provided with a flange held between the engine head and the resin made intake manifold, and wherein the flange is provided with an elastic flange portion and a fixed flange portion and a space is defined between the elastic and fixed flange portions.

2. An intake system of an internal combustion engine according to claim 1, wherein the elastic flange portion is provided with a protrusion contacting with the engine head, a flange surface of the cartridge facing a mounting surface of the engine head is located at a position recessed from a mounted surface of the resin made intake manifold.

3. An intake system of an internal combustion engine according to claim 2, wherein the protrusion is provided in the vicinity of each corner of the elastic flange portion.

4. An intake system of an internal combustion engine according to claim 2, wherein the protrusion is provided at an outer circumferential side of the flange surface of the elastic flange portion contacting with the engine head.

5. An intake system of an internal combustion engine according to claim 2, wherein the protrusion is integrally formed with the elastic flange portion.

6. An intake system of an internal combustion engine according to claim 1, wherein the elastic flange portion elastically deforms toward the space between the elastic and fixed flange portions.

7. An intake system of an internal combustion engine according to claim 1, wherein a clearance is respectively provided between the inner circumferential surface of the receiving portion and an outer circumferential surface of the elastic flange portion and between the inner circumferential surface of the receiving portion and an outer circumferential surface of the fixed flange portion, and a positioning protrusion is provided at one of the outer circumferential surface of the elastic flange portion and the outer circumferential surface of the fixed flange portion for positioning the cartridge.

8. An intake system of an internal combustion engine according to claim 7, wherein the positioning protrusion is provided at one of a corner of the elastic flange portion and a corner of the fixed flange portion.

9. An intake system of an internal combustion engine according to claim 7, wherein the positioning protrusion is integrally formed with one of the elastic flange portion and the fixed flange portion.

* * * * *